US007775589B1

(12) United States Patent
Cvek

(10) Patent No.: US 7,775,589 B1
(45) Date of Patent: Aug. 17, 2010

(54) UPHOLSTERY MOUNTING SYSTEM AND MECHANISM

(76) Inventor: Sava Cvek, 40 Woodland Rd., Jamaica Plain, MA (US) 02130

( * ) Notice: Subject to any disclaimer, the term of this patent is extended or adjusted under 35 U.S.C. 154(b) by 544 days.

(21) Appl. No.: 11/686,474

(22) Filed: Mar. 15, 2007

Related U.S. Application Data

(60) Provisional application No. 60/782,354, filed on Mar. 15, 2006.

(51) Int. Cl.
*A47C 31/02* (2006.01)

(52) U.S. Cl. ..... 297/218.2; 297/218.3; 297/218.5

(58) Field of Classification Search ..... 297/218.1, 297/218.2, 218.3, 218.4, 218.5
See application file for complete search history.

(56) References Cited

U.S. PATENT DOCUMENTS 3,174,797 A * 3/1965 Neufeld ..... 297/218.3 X
5,318,346 A * 6/1994 Roossien et al. ..... 297/300.1
5,630,643 A * 5/1997 Scholten et al. ..... 297/218.2
5,879,055 A * 3/1999 Dishner et al. ..... 297/218.3 X
6,220,661 B1 * 4/2001 Peterson ..... 297/218.4

* cited by examiner

*Primary Examiner*—Anthony D Barfield
(74) *Attorney, Agent, or Firm*—O'Connell Law Firm

(57) ABSTRACT

An upholstery mounting system for an article of furniture with a furniture member, such as a chair back, and an upholstery backing member for being removably coupled to the furniture member. A plurality of mounting clips are fixed to one of the upholstery backing member and the furniture member, and a corresponding a plurality of mounting brackets are fixed to the other of the furniture member and the upholstery backing member. The mounting clips can have raised central portions that define apertures, and the mourning clips have elongate engaging members for being matingly received through the apertures in the mounting brackets for coupling the furniture member and the upholstery backing member. One mounting clip can have a longer elongate engaging member to facilitate alignment during coupling. A protuberance on each elongate engaging member can enable a mechanical engagement between the mounting brackets and the mounting clips.

20 Claims, 5 Drawing Sheets

UPHOLSTERY MOUNTING SYSTEM AND MECHANISM

FIELD OF THE INVENTION

The present invention relates generally to furniture. More particularly, disclosed and protected herein are systems and mechanisms for mounting upholstery to a furniture structure.

BACKGROUND OF THE INVENTION

Under the prior art, the application of upholstery to furniture structures has required significant manual labor. For example, upholstered folding chairs commonly require the preliminary attachment of upholstery to a separate backing structure, such as a laminated wood panel. That backing structure is then fixed to a chair hack or frame by, for example, mechanical fasteners, such as staples, screws, rivets, or the like.

It is a recognized problem that such attachment methods lead to an aesthetically flawed appearance in the resulting article of furniture. Fasteners are often unavoidably left exposed, and the application of the fasteners to the backing structure commonly results in unattractive and potentially dangerous damage and splintering of the backing structure. Furthermore, edges of the upholstery fabric can be left undesirably visible. Even further, the exposed fasteners and fabric edges can be vulnerable to damage and tampering.

On a more general level, it will be appreciated that, for each given upholstery application, numerous furniture upholstery options are possible, including with respect to color, texture, material type, and other characteristics. Similarly, multiple frame, seat, back, and other structural options are typically available to each manufacturer. Accordingly, manufacturers are commonly faced with the competing goals of providing as wide a range as possible to suppliers and consumers while limiting the number of pieces of inventory required for achieving the same.

The present inventor has recognized that providing an expedient mechanism for securely attaching a hacking structure to a furniture member, whether a chair hack or chair frame, would represent an important step toward enabling the simultaneous accomplishment of the competing goals of limiting necessary inventory while enabling widely varied upholstery options. It would also be desirable to provide such a mechanism that allows the coupling of a backing structure to a chair member without a need for specialized tools. Still further, it would be advantageous to enable a non-destructive separation of a backing structure in relation to a chair member to facilitate cleaning, repair, replacement, or the like.

SUMMARY OF THE INVENTION

With a knowledge of the above summarized state of the art, the present inventor has created the upholstery mounting system disclosed herein with the basic object of providing a system for enabling the attachment of upholstery to a furniture structure in an expedient yet secure manner.

A further object of the invention is to provide a system for attaching upholstery to a furniture structure without a need for specialized tools.

Another object of the invention is to provide a system for enabling the attachment of upholstery to a furniture structure in a manner that permits the non-destructive removal of the upholstery from the furniture structure.

Still another object of embodiments of the invention is to provide a system for enabling the attachment of upholstery to a furniture structure that enables the provision of a wide variety of upholstery options while facilitating reduced inventory requirements to accomplish the same.

These and further objects and advantages of embodiments of the invention will become obvious not only to one who reviews the present specification and drawings but also to one who has an opportunity to make use of an embodiment of the instant invention for an upholstery mounting system disclosed herein. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

One embodiment of the upholstery mounting system can be founded on an upholstery hacking member with an outer surface and au inner surface and a first end and a second end in combination with a furniture member comprising a portion of an article of furniture. A plurality of mounting clips are fixed to one of the inner surface of the upholstery backing member or to the furniture member. Each mounting clip can have an elongate engaging member disposed at an acute angle relative to the member to which the mounting clip is fixed. A plurality of mounting brackets can be fixed to the furniture member or to the inner surface of the upholstery hacking member in correspondence to the plurality of mounting clips. Each mounting bracket can have a raised central portion that defines an aperture. Under this arrangement, the upholstery backing member can be retained relative to the furniture member by an insertion of the elongate engaging members of the mounting clips through the apertures of correspondingly disposed mounting brackets.

In certain embodiments, one of the mounting dips can have an elongate engaging member of a length greater than a length of the elongate engaging members of the remaining of the plurality of mounting clips. With that, the mounting dip with the longer elongate engaging member will comprise a leading mounting clip that can be first engaged with a corresponding mounting bracket to facilitate an alignment and engagement of the mounting clips and the mounting brackets. The upholstery mounting system can have at least three mounting clips and three corresponding mounting brackets. The leading mounting clip and the corresponding mounting bracket can be centrally disposed on the upholstery backing member and the furniture member. In such a case, the second and third mounting clips and corresponding mounting brackets can be disposed outboard of the leading mounting clip and the corresponding mounting bracket to first and second sides thereof. Furthermore, the elongate engaging members of the mounting clips and the apertures of the mounting brackets can be disposed in longitudinal alignment with the upholstery hacking member and the furniture member to enable a most effective engagement of the mounting brackets and the mounting clips.

Particular embodiments of the invention can have elongate engaging members of the mounting clips disposed at an angle of approximately 5 degrees to an angle of approximately 9 degrees, preferably an angle of approximately 8 degrees, relative to the member to which the mounting dips are fixed. With this, a reception of the elongate engaging members of the mounting clips into the central apertures of the mounting brackets can be facilitated while preventing a digging in of the elongate engaging members into the member to which the mounting brackets are fixed.

To prevent the central portions of the mounting brackets from becoming wedged in relation to the proximal portions of the elongate engaging members, the elongate engaging members of the mounting clips can have proximal ends maintained in spaced relation from the member to which the mounting clips are fixed. While such a spaced relation can be accomplished in any suitable manner, one embodiment of the invention can accomplish such a spacing by virtue of a double bend interposed between a base portion and the elongate engaging members of the mounting clips. The double bend can have a first, outward bend projecting outwardly from the member to which the mounting clips are fixed, a second bend disposed to orient the elongate engaging members at the acute angle relative to the member to which the mounting clips are fixed, and a spacing portion interposed between the first and second bends.

In constructions of the invention, an outwardly projecting protuberance can be disposed in a body portion of each elongate engaging member of the mounting clips to enable a mechanical engagement between the elongate engaging members and the central portions of the mounting brackets. Particularly where such a protuberance is incorporated, an outwardly protuberating portion can be included on the central portion of each mounting bracket for facilitating a reception of the protuberances disposed on the body portions of the elongate engaging members.

The type of furniture member can vary within the scope of the invention. In certain embodiments, for example, the furniture member can comprise a chair back, in such a case, the outer surface of the upholstery backing member can be contoured for functioning as an upholstered chair back surface. Of course, embodiments of the invention will commonly include a layer of upholstery fixed to the upholstery backing member, such as by adhesive, fasteners, or any other effective means.

One will appreciate that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

It will be appreciated that the upholstery mounting systems and mechanisms disclosed herein are subject to widely varied embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction, descriptions of geometry, and illustrations of inventive concepts are mere examples of the many possible manifestations of the invention.

Figure 1:
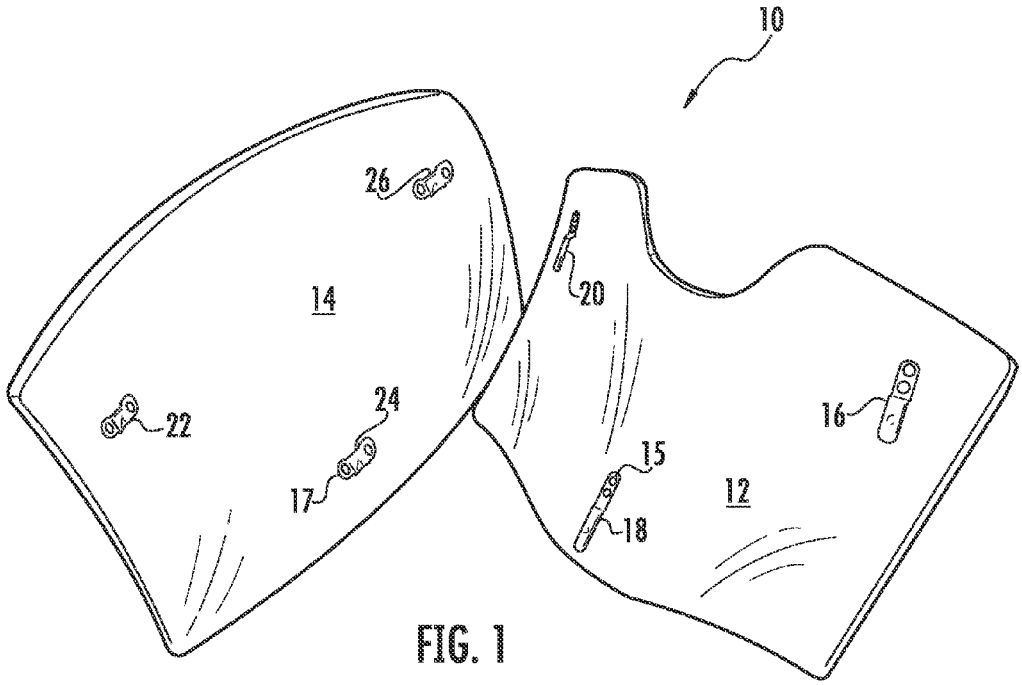
FIG. 1 is a perspective view of an upholstery mounting system pursuant to the present invention showing an upholstery backing structure separated from a chair member.
Figure 2:
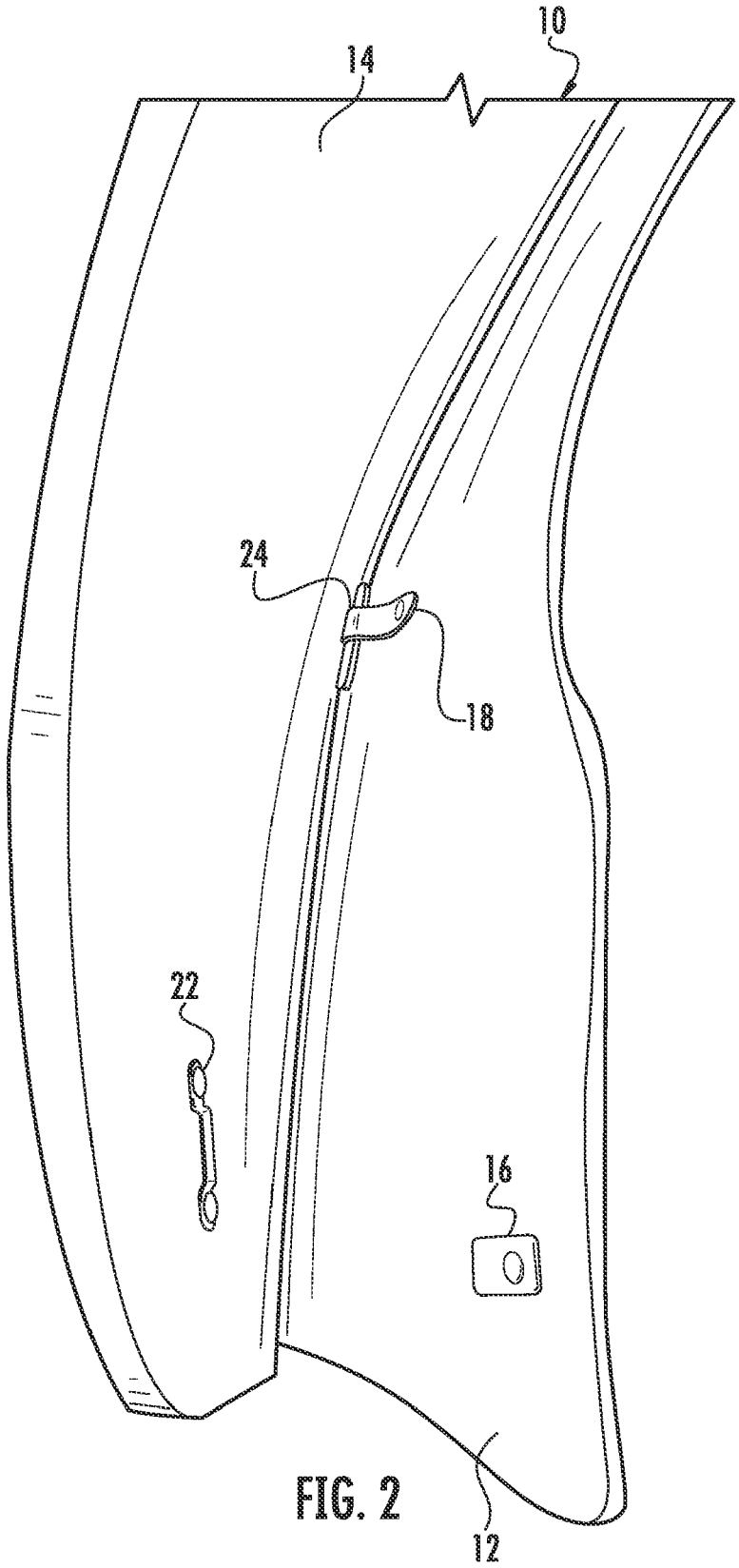
FIG. 2 is a perspective view of the upholstery mounting system of FIG. 1 in a partially coupled configuration.
Figure 3:
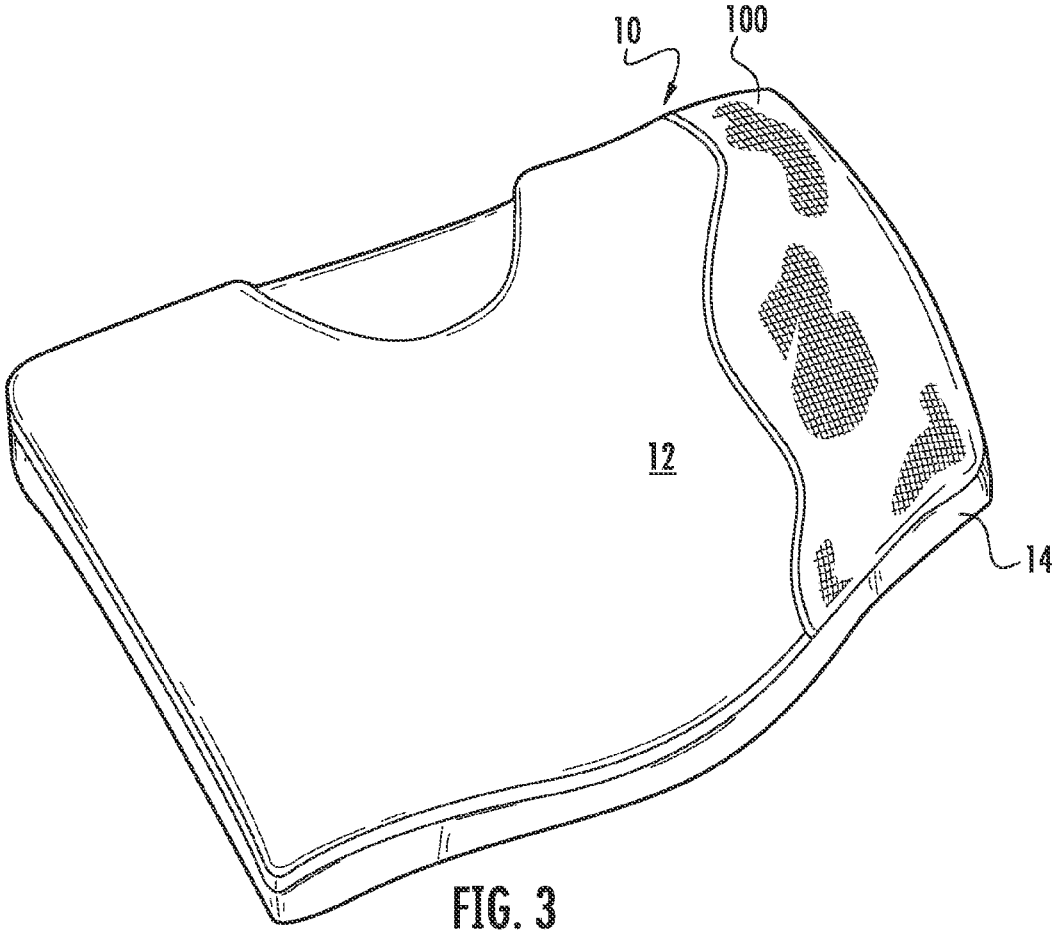
FIG. 3 is a perspective view of the upholstery mounting system of FIGS. 1 and 2 in a fully coupled configuration.

Looking more particularly to the drawings, an exemplary upholstery mounting system pursuant to the instant invention is indicated generally at 10 in FIGS. 1 through 3 in varied stages of assembly. In FIG. 1, the upholstery mounting system 10 is depicted with an upholstery backing structure 12 separated from a furniture member 14. The hacking structure 12 and the furniture member 14 are shown partially assembled in FIG. 2 and then fully assembled in FIG. 3.

In this example, the furniture member 14 comprises a contoured chair back panel, and the backing structure 12 is a correspondingly contoured panel of material for functioning as an upholstered chair back surface. However, it will be noted that numerous alternative furniture and other applications are readily possible and within the scope of the invention. The backing structure 12 and the furniture member 14 can be formed from any suitable material or combination thereof, including wood, metal, a polymer, fiberglass, or any other sufficiently rigid and durable material.

Upholstery 100, possibly in layers and possibly with padding, can be applied to the backing structure 12 by any effective method, such as by stapling, adhesive, sewing, or any other suitable arrangement. It would also be within the scope of the invention to have the upholstery backing structure 12 itself be padded, formed form a resilient material, and, additionally or alternatively, decorated, designed, or otherwise crafted to be enable its own surface to be exposed in a furniture application.

However configured, the backing structure 12 can be coupled to the furniture member 14 as in FIG. 3. With that, the article of furniture formed by or including the furniture member 14 would be effectively upholstered. As described below, the backing structure 12 could, if necessary or desirable, be separated from the furniture member 14 in a non-destructive manner to enable repair, cleaning, replacement, or the like.

In the illustrated embodiment, the backing structure 12 has a plurality of mounting clips 16, 18, and 20 fixed thereto. Any effective means can be employed for fastening the mounting clips 16, 18, and 20 to the backing structure 12, including adhesive, integral formation, partially embedding, and mechanical fasteners 15. The mechanical fasteners 15 can comprise, for example, screws, vets, nails, bolts, or any other effective fastener. In this example, the mounting clips 16, 18, and 20 comprise a centrally disposed, leading mounting clip 18 and first and second laterally disposed, trailing mounting clips 16 and 20. With the present furniture member 14 comprising a contoured chair back, the leading mounting clip 18 is disposed at a lower and, therefore, leading position in relation to the trailing mounting clips 16 and 20, which are disposed at generally equal and opposite positions to one another and at higher and, therefore, trailing positions in relation to the leading mounting clip 18. Of course, the upper and lower concepts referenced herein assume that the furniture member 14 is disposed in a generally upright configuration.

The furniture member 14 has a plurality of mounting brackets 22, 24, and 26 mounted thereon. The mounting brackets 22, 24, and 26 can be fixed to the furniture member 14 by any suitable means, such as mechanical fasteners 17, adhesive, embedding, integral formation, or any other effective arrangement. The mounting brackets 22, 24, and 26 are mounted to correspond in location to the locations of the mounting clips 16, 18, and 20 of the backing structure 12 to enable a mating engagement as discussed hereinbelow. As a result, there is a centrally disposed, leading mounting bracket 24 and first and second laterally disposed, trailing mounting brackets 22 and 26.

For convenience, this preferred embodiment is described and shown as having the mounting clips 16, 18, and 20 fixed to the backing structure 12 and the mounting brackets 22, 24, and 26 fixed to the furniture member 14. It will naturally be appreciated that sonic or all of the mounting clips 16, 18, and 20 and the mounting brackets 22, 24, and 26 could be oppositely disposed.

Figure 4B:
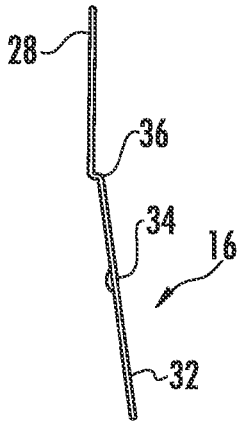
FIG. 4B is a view in right side elevation of the mounting clip of FIG. 4A.
Figure 4A:
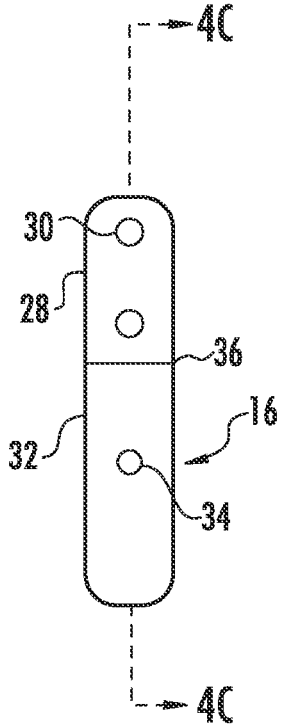
FIG. 4A is a view in front elevation of a mounting clip of an upholstery mounting system as disclosed herein.
Figure 4C:
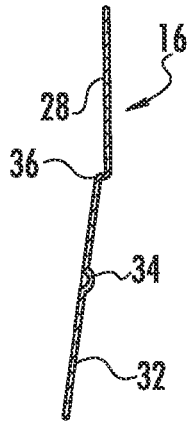
FIG. 4C is a cross-sectioned view in left side elevation of the mounting clip taken along the line 4C-4C in FIG. 4A.
Figure 5C:
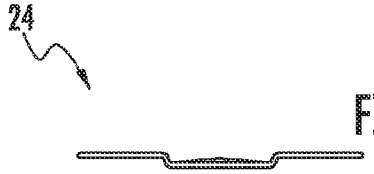
FIG. 5C is a top plan view of the mounting bracket of FIG. 5A.
Figure 5D:
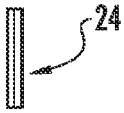
FIG. 5D is a view in right side elevation of the mounting bracket of FIG. 5A.
Figure 5A:
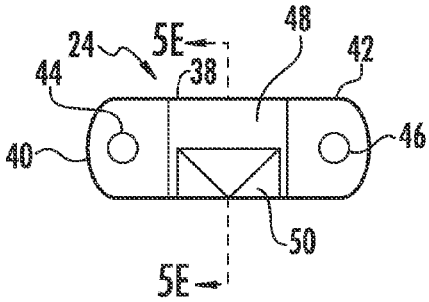
FIG. 5A is a view in front elevation of a mounting bracket of an upholstery mounting system pursuant to the instant invention.
Figure 5E:
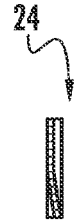
FIG. 5E is a cross-sectioned view in left side elevation of the mounting bracket taken along the line 5E-5E in FIG. 5A.
Figure 5B:
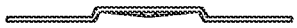
FIG. 5B is a bottom plan view of the mounting bracket of FIG. 5A.

A greater understanding of the construction of the mounting clips 16, 18, and 20 can be had with reference to FIGS. 4A through 4C where a mounting clip, in this case a laterally disposed mounting clip 16, is illustrated alone. While it need not necessarily be, the mounting clip 16 of FIGS. 4A through 4C is integrally formed from a single piece of material, such as metal, plastic, or another material. In one example, the material can be SAE1010 carbon steel. The mounting clip 16 has a base portion 28 with apertures 30 therein for enabling mounting to the hacking structure 12 of FIGS. 1 through 3. An elongate engaging member 32 is angularly disposed in relation to the base portion 28 and thus relative to a backing structure 12 to which the mounting clip 16 is fastened.

A double bend 36 is interposed between the proximal end of the engaging member 32 and the base portion 28 thereby to maintain a spacing between the proximal end of the engaging member 32 and a backing structure 12 to which the mounting clip 16 is fastened. A protuberance 34 can be disposed along the engaging member 32 projecting what can be considered inwardly, which would be toward a backing structure 12. The protuberance 34 in this embodiment comprises a rounded projection. As will be described below, the protuberance 34 can be employed to engage the corresponding mounting bracket 22, 24, or 26. Of course, any dimensions referenced herein or depicted in the drawings, while possibly preferred, are merely exemplary.

FIGS. 5A through 5E depict a mounting bracket 24, which is exemplary of the mounting brackets 22, 24, and 26. The mounting bracket 24 has lateral base portions 40 and 42 that are bridged by a raised central portion 38. The base portions 40 and 42 have apertures 44 and 46 disposed therein for enabling a fastening to a furniture member 14 as in FIGS. 1 through 3. The central portion 38 in this example has a generally flat portion 48 and a protuberating portion 50 that projects what can be considered outwardly, which would be away from a furniture member 14 to which the mourning bracket 24 is fastened. In this example, the protuberating portion 50 comprises a half pyramid shape with a tip of the half pyramid disposed at a midpoint of the central portion 38.

Under these constructions, the mounting clips 16, 18, and 20 and the mounting brackets 22, 24, and 26 can be fixed to the backing structure 12 and the furniture member 14 in the configuration shown and described. Assuming the backing structure 12 and the furniture member 14 each to have a first end, which in this case comprises what will be a lower end of a seat back, and a second end, which will be an upper end of a seat back, the mounting clips 16, 18, and 20 can be fixed in place longitudinally aligned with a centerline of the backing structure 12 and with the engaging member 32 projecting toward the first end of the backing structure 12. The mounting brackets 22, 24, and 26 can be fixed to the furniture member 14 in longitudinal alignment with a centerline of the furniture member 14 with the protuberating portion 50 disposed toward the second end of the backing structure 12.

The engaging members 32 of the mounting clips 16, 18, and 20 can be slidably received into the corresponding mounting brackets 22, 24, and 26. The protuberances 34 of the engaging members 32 can engage and slide under the protuberating portions 50 of the mounting brackets 22, 24, and 26. When the engaging members 32 and the mounting brackets 22, 24, and 26 are sufficiently engaged, the protuberances 34 will pass beyond the central portion 38 of the mounting brackets 22, 24, and 26 and spring outwardly thereby mechanically locking the mounting clips 16, 18, and 20 relative to the mounting brackets 22, and 24, and 26. With this, the backing structure 12 and the furniture member 14 are locked together. Advantageously, the backing structure 12 and the furniture member 14 can be separated by sliding the engaging members 32 from within the mounting brackets 22, 24, and 26 while enabling the protuberances 34 again to pass under the central portions 38 of the mounting brackets 22, 24, and 26, such as by depressing the engaging members 32.

To facilitate the engagement of the multiple mounting clips 16, 18, and 20 with the mounting brackets 22, 24, and 26, one of the mounting clips 16, 18, or 20, such as the centrally disposed, leading mounting clip 18, can have an engaging member 32 that is longer than that of the remaining clips 16 and 20. With that, the leading mounting clip 18 will engage its corresponding mounting bracket 24 first when the mounting brackets 22, 24, and 26 are mounted in direct correspondence to the mounting of the base portions 28 of the mounting dips 16, 18, and 20. With this, the alignment of the mounting clips 16 and 20 with the mounting brackets 22 and 26 can be ensured.

The angle of the engaging member 32 in relation to the base portion 28 and thus the backing structure 12 has been found to be relevant to the ease with which the backing structure 12 and the furniture member 14 can be engaged. Where the angle is smaller than a given minimum, inducing the engaging members 32 to slide into the mounting brackets 22, 24, and 26 can be difficult. Where the angle is larger than a given maximum, it has been found that the tips of the engaging members 32 tend to dig into the furniture member 14, which can be wood, plastic, or any other suitable material as can be the backing structure 12. At present, it appears that the angle of the engaging member 32 in relation to the base portion 28 can vary within an acceptable range of from 5 to 9 degrees. However, an angle of 8 degrees appears to be optimal for its ease of engagement of the engaging members 32 with the mounting brackets 22, 24, and 26 and its tendency not to exhibit a digging in effect of the engaging members 32 in relation to the furniture member 14. Of course, other angles could be employed depending on, among other things, material selection and further considerations.

With the foregoing exemplary embodiments of the upholstery mounting system 10 disclosed, it will be appreciated that a number of advantages over the prior art are made possible by the present invention. By way of example, by use of the mounting clips 16, 18, or 20 in combination with the mounting brackets 22, 24, and 26, upholstery can be coupled to a furniture structure in a secure yet expedient manner. Furthermore, upholstery can be attached to a furniture structure without a need for specialized tools. Upholstery can also be removed and replaced relative to a furniture structure in a non-destructive manner. As a result, a wide variety of upholstery options can be offered with minimized inventory requirements.

With certain details and embodiments of the present invention for an upholstery mounting system and method disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. An upholstery mounting system for an article of furniture, the upholstery mounting system comprising:

an upholstery backing member with an outer surface, an inner surface, a first end, and a second end;

a furniture member comprising a portion of an article of furniture;

a plurality of mounting clips fixed to the inner surface of the upholstery backing member or to the furniture member wherein each mounting clip comprises an elongate engaging member disposed at an acute angle away from the member to which the mounting clip is fixed; and a plurality of mounting brackets fixed to the furniture member or to the inner surface of the upholstery backing member in correspondence to the plurality of mounting clips wherein each mounting bracket comprises a raised central portion spaced from the furniture member or the inner surface of the upholstery backing member to define an aperture between the raised central portion and the furniture member or the inner surface of the upholstery backing member;

whereby the upholstery backing member can be retained relative to the furniture member by an insertion of the elongate engaging members of the mounting clips through the apertures of correspondingly disposed mounting brackets between the raised central portion and the furniture member or the inner surface of the upholstery backing member.

2. The upholstery mounting system of claim 1 wherein one of the plurality of mounting clips has an elongate engaging member of a length greater than a length of the elongate engaging members of the remaining of the plurality of mounting clips whereby the one mounting clip with the elongate engaging member of greater length comprises a leading mounting clip that can be first engaged with a corresponding mounting bracket.

3. The upholstery mounting system of claim 2 wherein there are at least three mounting clips and three corresponding mounting brackets, wherein the leading mounting clip and the corresponding mounting bracket are centrally disposed on the upholstery backing member and the furniture member, and wherein second and third mounting clips and corresponding mounting brackets are disposed outboard of the leading mounting clip and the corresponding mounting bracket to first and second sides thereof.

4. The upholstery mounting system of claim 2 wherein the elongate engaging members of the mounting clips and the apertures of the mounting brackets are disposed in longitudinal alignment with the upholstery backing member and the furniture member.

5. The upholstery mounting system of claim 1 wherein the elongate engaging members of the mounting clips are substantially straight and are disposed at an outward angle of approximately 5 degrees to an angle of approximately 9 degrees relative to the member to which the mounting clips are fixed.

6. The upholstery mounting system of claim 5 wherein the elongate engaging members of the mounting clips are disposed at an outward angle of approximately 8 degrees relative to the member to which the mounting clips are fixed.

7. The upholstery mounting system of claim 1 wherein the elongate engaging members of the mounting clips have proximal ends maintained in spaced relation from the member to which the mounting clips are fixed.

8. The upholstery mounting system of claim 7 wherein the mounting clips further comprise a base portion for mounting to the member to which the mounting clips are fixed, wherein a double bend is interposed between the base portion and the elongate engaging members of the mounting clips, and wherein the double bend has a first, outward bend projecting outwardly from the member to which the mounting clips are fixed, a second bend disposed to orient the elongate engaging members at the acute angle relative to the member to which the mounting clips are fixed, and a spacing portion interposed between the first and second bends whereby the proximal ends of the elongate engaging members are maintained in spaced relation from the member to which the mounting clips are fixed.

9. The upholstery mounting system of claim 1 further comprising an inwardly projecting protuberance disposed in a body portion of each elongate engaging member of the mounting clips for enabling a mechanical engagement between the elongate engaging members and the central portions of the mounting brackets.

10. The upholstery mounting system of claim 9 further comprising an outwardly protuberating portion on the central portion of each mounting bracket for facilitating a reception of the protuberances disposed on the body portions of the elongate engaging members.

11. The upholstery mounting system of claim 1 wherein the furniture member comprises a chair back and wherein the outer surface of the upholstery backing member is contoured for functioning as an upholstered chair back surface.

12. The upholstery mounting system of claim 1 further comprising a layer of upholstery fixed to the upholstery backing member.

13. An upholstery mounting system for an article of furniture, the upholstery mounting system comprising:

an upholstery backing member with an outer surface, an inner surface, a first end, and a second end;

a furniture member comprising a portion of an article of furniture;

a plurality of mounting clips fixed to the upholstery backing member or the furniture member wherein each mounting clip comprises a base portion and an elongate engaging member disposed at an acute angle relative to away from the member to which the mounting clip is fixed;

a plurality of mounting brackets fixed to the furniture member or the upholstery backing member in correspondence to the plurality of mounting clips wherein each mounting bracket comprises first and second lateral base portions and a raised central portion disposed between the base portions spaced from the furniture member or the inner surface of the upholstery backing member to define an aperture between the raised central portion and the furniture member or the inner surface of the upholstery backing member; and an inwardly projecting protuberance disposed in a body portion of each elongate engaging member of the mounting clips for enabling a mechanical engagement between the elongate engaging members and the central portions of the mounting brackets;

wherein one of the plurality of mounting clips has an elongate engaging member of a length greater than a length of the elongate engaging members of the remaining of the plurality of mounting clips whereby the one mounting clip with the elongate engaging member of greater length comprises a leading mounting clip that can be first engaged with a corresponding mounting bracket and wherein the elongate engaging members of the mounting clips and the apertures of the mounting brackets are disposed in longitudinal alignment with the upholstery backing member and the furniture member;

whereby the upholstery backing member can be retained relative to the furniture member by an insertion of the elongate engaging members of the mounting clips through the apertures of correspondingly disposed mounting brackets between the raised central portion and the furniture member or the inner surface of the upholstery backing member.

14. The upholstery mounting system of claim 13 wherein there are at least three mounting clips and three corresponding mounting brackets, wherein the leading mounting clip and the corresponding mounting bracket are centrally disposed on the upholstery backing member and the furniture member, and wherein second and third mounting clips and corresponding mounting brackets are disposed outboard of the leading mounting clip and the corresponding mounting bracket to first and second sides thereof.

15. The upholstery mounting system of claim 13 wherein the elongate engaging members of the mounting clips are substantially straight and are disposed at an angle of approximately 5 degrees to an angle of approximately 9 degrees relative to the member to which the mounting clips are fixed.

16. The upholstery mounting system of claim 15 wherein the elongate engaging members of the mounting clips are disposed at an angle of approximately 8 degrees relative to the member to which the mounting clips are fixed.

17. The upholstery mounting system of claim 13 wherein the elongate engaging members of the mounting clips have proximal ends maintained in spaced relation from the member to which the mounting clips are fixed.

18. The upholstery mounting system of claim 17 wherein a double bend is interposed between the base portion and the elongate engaging members of the mounting clips, wherein the double bend has a first, outward bend projecting outwardly from the member to which the mounting clips are fixed, a second bend disposed to orient the elongate engaging members at the acute angle relative to the member to which the mounting clips are fixed, and a spacing portion interposed between the first and second bends whereby the proximal ends of the elongate engaging members are maintained in spaced relation from the member to which the mounting clips are fixed.

19. The upholstery mounting system of claim 13 further comprising an outwardly protuberating portion on the central portion of each mounting bracket for facilitating a reception of the protuberances disposed on the body portions of the elongate engaging members.

20. The upholstery mounting system of claim 13 further comprising a layer of upholstery fixed to the upholstery backing member.

* * * * *